US011938388B2

(12) United States Patent
Richert et al.

(10) Patent No.: US 11,938,388 B2
(45) Date of Patent: Mar. 26, 2024

(54) MODULAR GAME ASSEMBLY

(71) Applicant: Richert Games LLC, North Royalton, OH (US)

(72) Inventors: Todd Michael Richert, North Royalton, OH (US); Troy Douglas Richert, North Royalton, OH (US)

(73) Assignee: Richert Games LLC, North Royalton, OH (US)

( * ) Notice: Subject to any disclaimer, the term of this patent is extended or adjusted under 35 U.S.C. 154(b) by 170 days.

(21) Appl. No.: 17/326,508

(22) Filed: May 21, 2021

(65) Prior Publication Data

US 2022/0370871 A1 Nov. 24, 2022

(51) Int. Cl.

| | |
|---|---|
| ***A63B 67/06*** | (2006.01) |
| ***A63B 71/00*** | (2006.01) |
| ***A63B 71/06*** | (2006.01) |

(52) U.S. Cl.

CPC ..... *A63B 67/06* (2013.01); *A63B 71/0036* (2013.01); *A63B 71/0672* (2013.01); *A63B 2210/50* (2013.01); *A63B 2225/09* (2013.01)

(58) Field of Classification Search

CPC ..... A63B 63/08; A63B 67/06; A63B 71/0036; A47B 13/10

USPC ..... 473/497

See application file for complete search history.

(56) References Cited

U.S. PATENT DOCUMENTS

| | | | | |
|---|---|---|---|---|
| 1,581,092 | A * | 4/1926 | Brooks | A63B 57/357 473/180 |
| 2,136,833 | A * | 11/1938 | Young | A63J 1/00 472/75 |
| 4,160,345 | A * | 7/1979 | Nalick | E04B 1/3211 52/81.4 |
| 4,927,161 | A * | 5/1990 | Brenneman | A63B 67/06 473/588 |
| 6,161,833 | A | 12/2000 | Gomez | |
| 7,237,777 | B2 * | 7/2007 | Digges, III | A63B 67/06 273/400 |
| 9,149,730 | B1 * | 10/2015 | Hauser | A63H 3/50 |
| 10,434,392 | B1 | 10/2019 | Riegel | |
| 11,022,251 | B1 * | 6/2021 | van Hoytema | F16M 13/02 |
| 2004/0108658 | A1 * | 6/2004 | Bartel | A63B 67/06 273/398 |
| 2014/0091526 | A1 * | 4/2014 | Nally | A63B 63/08 273/402 |

(Continued)

OTHER PUBLICATIONS

Champion Sports Saucer Cone Carrier, https://www.amazon.com/Champion-Sports-Saucer-Disc-Carrier/dp/B000KA2UOI/, first available on Jul. 1, 2003 (Year: 2003).*

(Continued)

*Primary Examiner* — Laura Davison
(74) *Attorney, Agent, or Firm* — Pearne & Gordon LLP

(57) ABSTRACT

A modular game assembly includes a central platform and a plurality of peripheral boards removably attached to the central platform to facilitate a tossing game between two or more players. The central platform is supported upon a support surface such that a planar surface thereof is elevated with respect to the support surface. Each peripheral board includes a front edge that is raised and supported by the central platform such that each peripheral board is downwardly inclined. Each peripheral board is in an abutting arrangement with adjacent peripheral boards.

17 Claims, 9 Drawing Sheets

(56) References Cited

U.S. PATENT DOCUMENTS

| | | | | |
|---|---|---|---|---|
| 2021/0354015 | A1* | 11/2021 | McMurtry | A63B 67/06 |
| 2022/0280851 | A1* | 9/2022 | Petrarca | A63B 67/06 |
| 2022/0339509 | A1* | 10/2022 | Carroll | A63B 67/06 |

OTHER PUBLICATIONS

Christopher Robeller, "HexBox Canopy," https://www.architektur.uni-kl.de/dtc/2019/08/17/hexbox-canopy-sydney/, Aug. 16, 2019 (Year: 2019).*

* cited by examiner

MODULAR GAME ASSEMBLY

FIELD OF THE INVENTION

The present invention relates to a game assembly, and more particularly, to a modular game assembly including a central platform and a plurality of peripheral boards that may be removably attached to the central platform to facilitate a tossing game between two or more players.

BACKGROUND OF THE INVENTION

Outdoor lawn games have become a common weekend pastime for people of all ages, both in the U.S. and abroad. One such lawn game, commonly referred to as "cornhole" in the U.S., requires players to take turns tossing small bags at a pair of inclined platforms to score points by either tossing a bag onto a respective platform or into a hole that is formed therethrough.

In particular, cornhole requires two inclined platforms to be set up and spaced from each other at a predetermined distance according to game rules. However, game setup is often imprecise since players generally do not take the time to space the platforms relative to each, or because players space the platforms via arbitrary forms of measure, e.g., the number of footsteps taken therebetween. Furthermore, games like cornhole can often become tedious after subsequent round play. For example, cornhole requires players to take turns tossing bags at a single platform until a scoring threshold is attained or exceeded. This may become uninteresting after successive rounds. Moreover, such lawn games require an even number of participants, e.g., 2, 4, 6, which may not always be feasible depending on a particular social gathering. Therefore, it is desirable to provide a modular game assembly for a new tossing game that is both entertaining and flexible with respect to the number of players that desire to participate in the tossing game.

SUMMARY OF THE INVENTION

The following presents a simplified summary in order to provide a basic understanding of the embodiments described herein. This summary is not an extensive overview nor is it intended to identify key or critical elements. Its sole purpose is to present some concepts in a simplified form as a prelude to the more detailed description that is presented later.

According to one embodiment, a modular game assembly for a tossing game is provided. The modular game assembly includes: a central platform including a planar surface that is elevated relative to a support surface supporting the central platform; and a plurality of peripheral boards, wherein each peripheral board is removably attached to the central platform and in an abutting arrangement therewith, and wherein each peripheral board is in an abutting arrangement with respect to an adjacent peripheral board.

According to another embodiment, a modular game assembly for a tossing game is provided. The modular game assembly includes: a hexagonal shaped central platform having an upper surface and a lower surface, and wherein a central opening extends between the upper surface and the lower surface, wherein the lower surface is elevated relative to a support surface supporting the central platform via a plurality of legs removably attached thereto, and wherein the upper surface is substantially horizontal when supported upon the support surface; and six edges, The modular game assembly further includes six hexagonal shaped, peripheral boards, wherein each peripheral board includes: an upper surface, a lower surface, and a central opening extending between the upper surface and the lower surface, wherein each peripheral board includes six edges, said six edges comprising a front edge, a pair of abutting edges, a pair of exposed edges, and a rear edge, wherein each front edge is removably attached a corresponding one of said six edges of said central platform, and wherein said abutting edges of each peripheral board are shaped and dimensioned such that said peripheral boards are in abutting arrangement with respect to one another along a longitudinal length thereof.

According to another embodiment, a method of game play for a tossing game is provided. The method includes: providing a modular game assembly including: a central platform, a plurality of peripheral boards removably attached to the central platform, and, a plurality of game bag sets corresponding to the respective peripheral boards; assigning an initial point value; selecting a plurality of players and assigning each of said plurality of players to a respective peripheral board; distributing said game bag sets to said respective players; commencing a tossing game whereby each player, in order, tosses a game bag from their respective game bag set at the modular game assembly according to rules, comprising: deducting points from a player's score when an opposing player tosses a game bag from their respective game bag set on said player's assigned peripheral board or through a scoring hole formed in said player's assigned peripheral board; adding points to said player's score when said player tosses a game bag from their respective game bag set on said player's assigned peripheral board or through a scoring hole formed in said player's assigned peripheral board; and determining a score after each toss, eliminating players from the game when their respective score is zero, and determining a winner when two of said players remain and, wherein the winner is one of said two players with a score equal to said initial point value or with points greater than zero.

Other features and aspects will be apparent from the following detailed description, the drawings, and the claims.

BRIEF DESCRIPTION OF THE DRAWINGS

Throughout the drawings and the detailed description, unless otherwise described, the same drawing reference numerals can be understood to refer to the same elements, features, and structures. The relative size and depiction of these elements may be exaggerated for clarity, illustration, and convenience.

DETAILED DESCRIPTION OF PREFERRED EMBODIMENTS

Figure 1A:
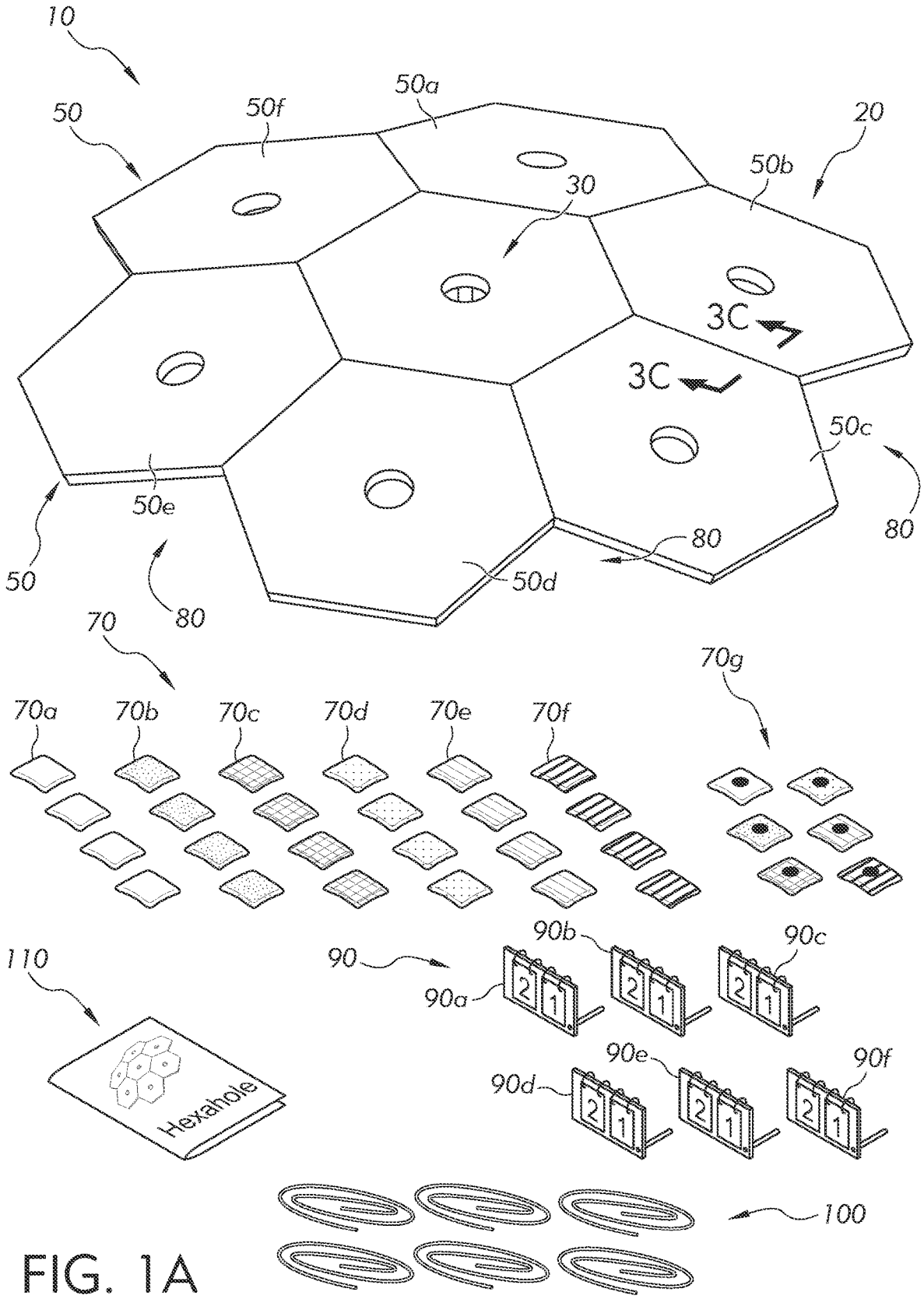
FIG. 1A is a front perspective view of an example modular game assembly shown in relation to example throwing bags, score counters, line elements, and an instruction manual as herein disclosed.

Example embodiments will now be described more fully hereinafter with reference to the accompanying drawings in which embodiments of the disclosure are shown. Whenever possible, the same reference numerals are used throughout the drawings to refer to the same or like parts. However, this disclosure may be embodied in many different forms and should not be construed as limited to the embodiments and drawings set forth herein.

Referring now to the drawings, FIG. 1A shows an example game kit 10 including a modular game assembly 20 according to a first embodiment. The game kit 10, in general, includes the modular game assembly 20, game bags 70, score counters 90, line elements 100, and an instruction manual 110. In some examples, it is contemplated that the game kit 10 can be made available in a carrying case (not shown) or carrier (FIG. 8), as discussed in detail below.

Figure 1B:
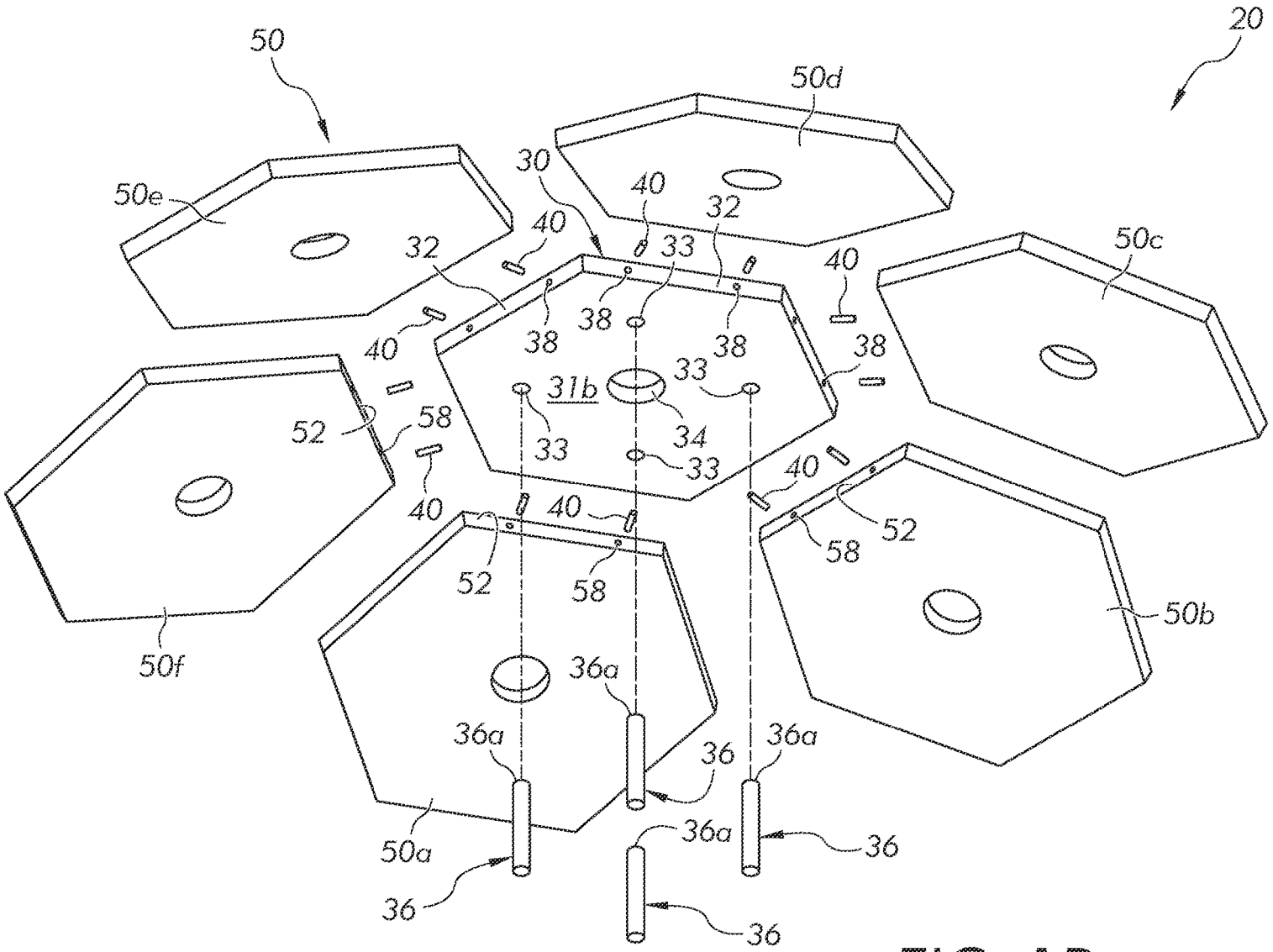
FIG. 1B is an exploded, perspective view of the modular game assembly of FIG. 1A.
Figure 2A:
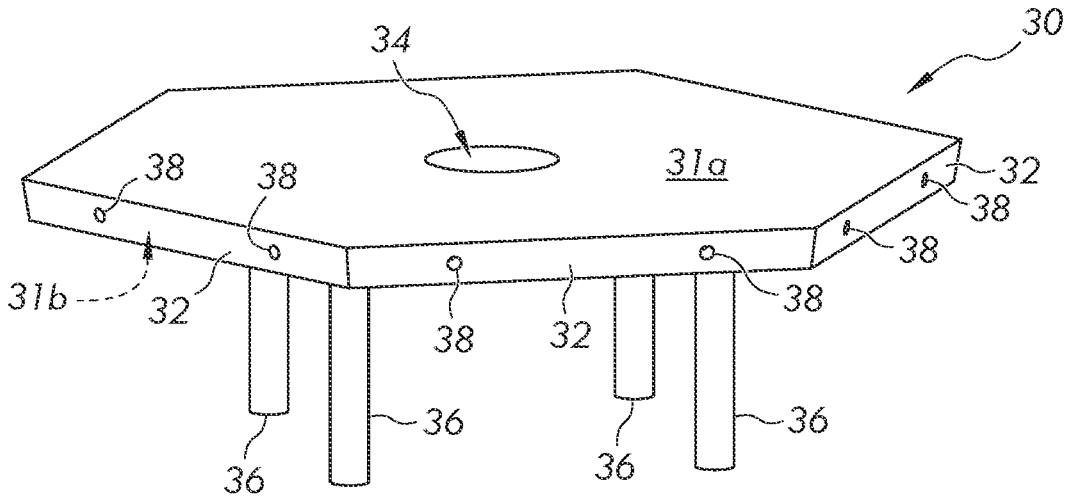
FIG. 2A is a front perspective view of an example central platform of the modular game assembly of FIG. 1B.

As shown in FIGS. 1A and 1B, the modular game assembly 20, includes a central platform 30 and a plurality of inclined, peripheral boards 50 that are removably attached to the central platform 30, as described in detail below. Referring to FIG. 2A, the central platform 30 embodies a hexagonal shaped body that is defined by a plurality of edge portions 32. Yet, it is contemplated that the central platform 30 may embody other shapes and forms, e.g., an octagonal or square-shaped body, etc. The central platform 30 is preferably made of a wood or plastic-injection molded material of suitable strength, although other rigid materials are also contemplated. A central opening 34 extends between an upper surface 31*a* and a lower surface 31*b* of the central platform 30 and defines a scoring hole that is dimensioned to receive game bags 70 (FIG. 1) that may be tossed therethrough, as described in detail below. A plurality of legs 36 extend from the lower surface 31*b* of the central platform 30 and are configured to support the central platform 30 upon a support surface (not shown), for example, a ground surface such as a lawn or a concrete surface, a table surface, or the like. In this manner, the central platform 30 is elevated with respect to the support surface such that the lower surface 31*b* of the central platform is spaced above the support surface corresponding to a length of each leg 36. In the illustrated embodiment, each leg 36 embodies an elongated, rounded structure having a constant diameter from an upper end to a lower end thereof. In some embodiments, it is contemplated that the legs 36 may take on different forms, for example, a leg having diameter that increases from an upper end to a lower end thereof, or a leg with a disc or plate element (not shown) attached at a lower end thereof for supporting the central platform on malleable surfaces, e.g., sand. In the illustrated embodiment, there are four legs 36. It is contemplated that any number of suitable legs may extend from the lower surface 31*b* of the central platform 30. Alternatively, the central platform 30 may not have any legs and be fully supported in a suspended manner by the peripheral boards 50.

In some embodiments, the legs 36 may be furnished separately as a part of the kit for packaging purposes prior to a point of sale. In such embodiments, the legs 36 may be secured to the lower surface 31*b* by inserting upper ends 36*a* (FIG. 1B) of the respective legs 36 into corresponding openings 33 formed in the lower surface 31*b* of the central platform 30, e.g., in a press-fit manner. Yet, it is contemplated that the upper ends 36*a* of the respective legs 36 may be threaded such that they may be rotatably inserted into corresponding, threaded openings (not shown) formed in the lower surface 31*b*. Yet, in other embodiments, it is contemplated that the upper end 36*a* of each leg 36 may be hinged (not shown) to the lower surface 31*b* such that the legs 36 may be pivoted to a substantially vertical position for game play, or to a substantially horizontal position for storage.

Referring to FIG. 2A, the upper surface 31*a* comprises a planar surface that is preferably a low friction surface (e.g., smooth plastic, sanded wood with a low friction coating). A low friction surface is particularly beneficial for enabling game bags 70 landing on the upper surface 31*a* to slide thereon, thereby facilitating a method of game play, as described in detail below. Yet, it is contemplated that in other embodiments, the upper surface 31*a* may comprise an impediment surface (e.g., rubber inlays, patterned notches or grooves, and the like) that is configured to prevent game bags 70 from sliding thereon, or to slide to a lesser extent than without the impediment surface.

Figure 2B:
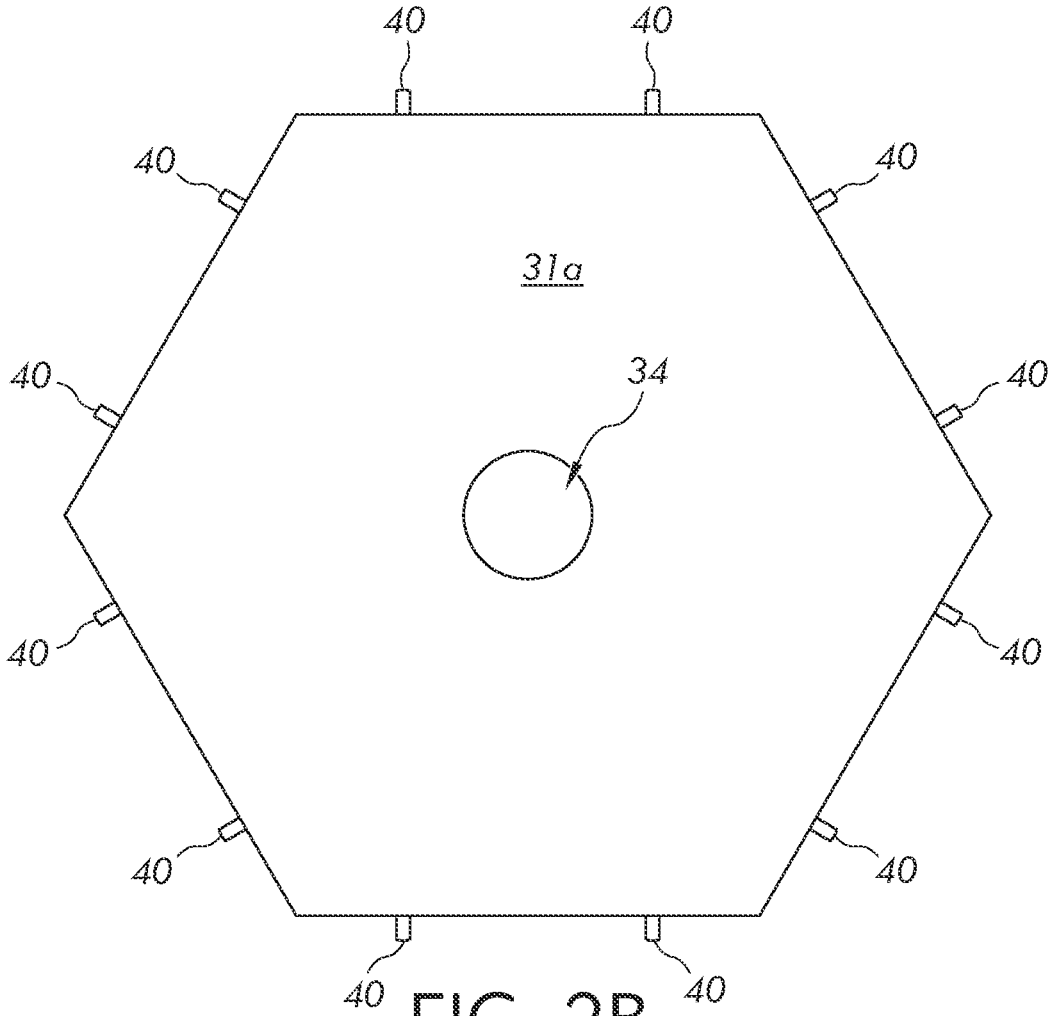
FIG. 2B is a top view of the central platform of FIG. 2A.

Referring to FIGS. 1B, 2A-2B, one or more openings or bores 38 may be formed along edge portions 32 of the central platform 30 for slidably receiving dowel pins or pegs 40 that are configured to removably attach peripheral boards 50 to the central platform 30. Yet, it is contemplated that the edge portions 32 of the central platform 30 may include other suitable attachment means disposed thereon or formed therein for securing the peripheral boards 50 thereto, such as, for example, eye hooks (see e.g., FIG. 6), hinges, hooks, resilient snaps, clasps, hooks, keys and slots, tongue and grooves, resilient clips/tabs, removable fasteners (screws, nuts, bolts), and the like. Additionally or alternatively, one or more of the peripheral boards 50 can be rotatably attached to the central platform 30, such as via removable or nonremovable hinges or the like.

Figure 3A:
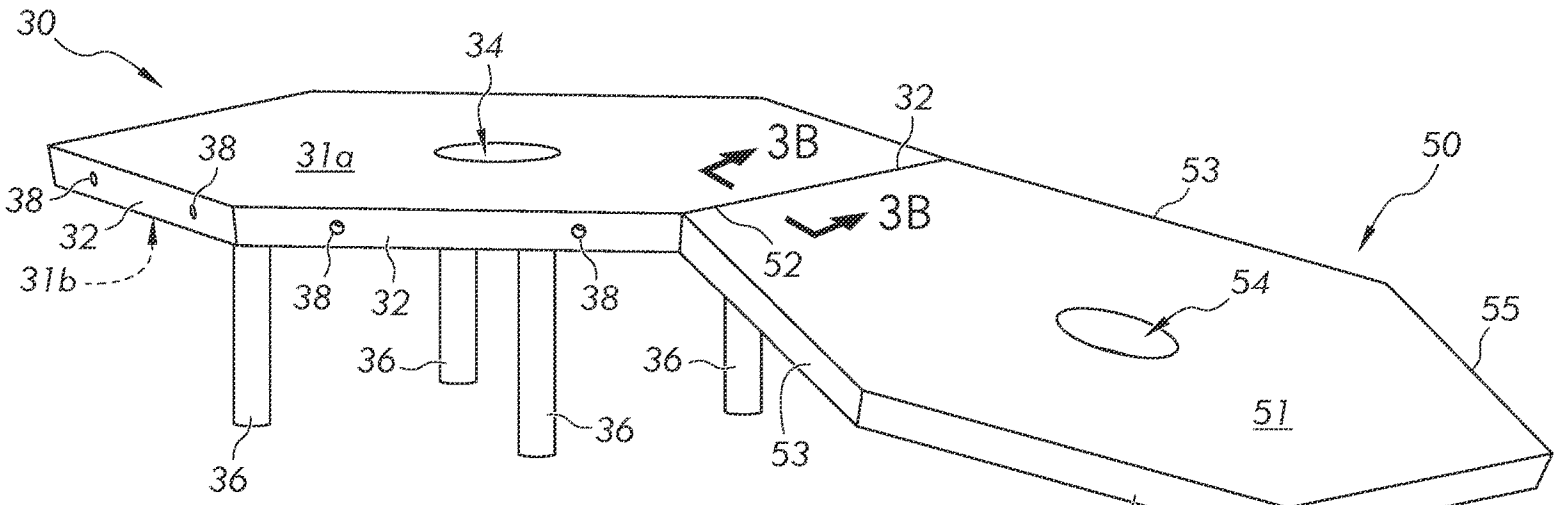
FIG. 3A is front perspective view of an example peripheral board connected to the central platform.

Referring to FIG. 3A, each peripheral board 50 embodies a hexagonal-shaped body defined by a plurality of edge portions 52, 53, 55, and 56. Yet, it is contemplated that each peripheral board 50 may embody other shapes and forms, e.g., an octagonal-shaped body, rectangular (see e.g., FIG. 7), or square-shaped body, etc. Additionally, one or more peripheral boards may have a different shape than another. Each peripheral board 50 is preferably made of a wood or plastic-injection molded material of suitable strength, although other rigid materials are also contemplated. A central opening 54 extends between an upper surface 51 and a lower surface (not shown) of each peripheral board 50 and defines a scoring hole that is dimensioned to receive game bags 70 (FIG. 1) that are tossed therethrough, as described in detail below. Preferably, the upper surface 51 of each peripheral board 50 is visually distinctive relative to the upper surfaces of the other peripheral boards 50 and can be coated or molded with distinct colors or include other surface indicia for achieving the same.

Furthermore, the upper surface 51 of each peripheral board 50 comprises a planar surface that is preferably a low friction surface. e.g., smooth plastic, sanded wood with a low friction coating. In particular, the upper surface 51 of each peripheral board 50 is designed with a suitable friction coefficient that enables game bags 70 landing on the upper surface 51 to slide thereon for facilitating a method of game play (discussed below), but without slipping to the support surface (e.g., a lawn, concrete surface, table) when the peripheral boards 50 are secured to the central platform 30 and inclined relative to the support surface. Yet, in other embodiments, it is contemplated that the upper surface 51 of each peripheral board 50 may include an impediment surface (e.g., rubber inlays, notched surfaces or grooves, and the like) for providing a frictional interface such that game bags 70 thrown on the upper surface 51 do not slide thereon, or slide to a lesser extent than without the impediment surface.

Figure 3C:
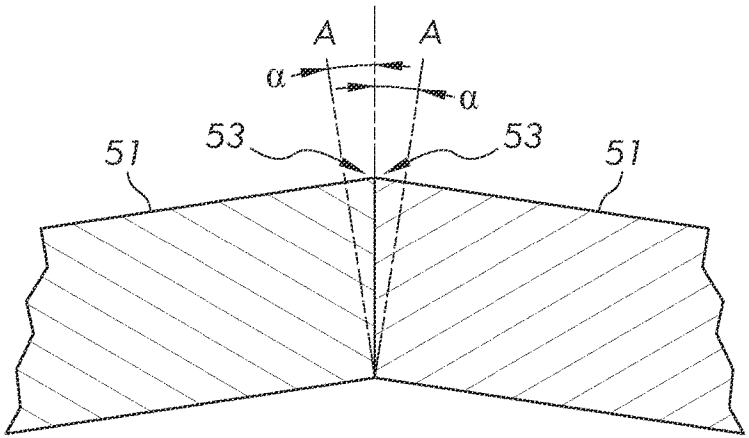
FIG. 3C is a partial, section view of the interface between adjacent peripheral boards taken along line 3C-3C of FIG. 1A.
Figure 3B:
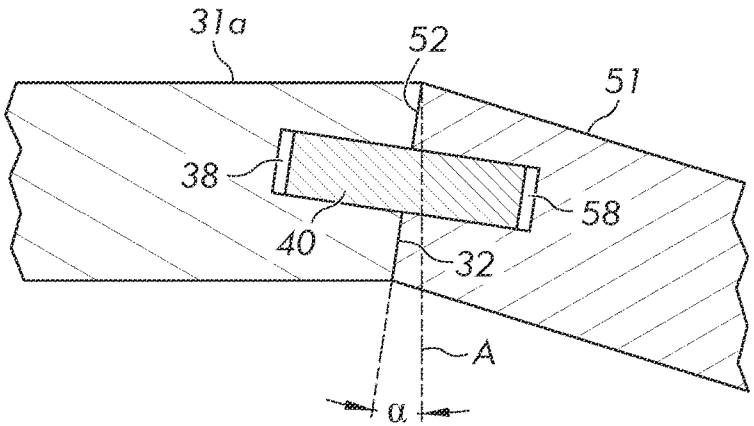
FIG. 3B is a partial, section view of the interface between the central platform and the peripheral board taken along line 3B-3B of FIG. 3A.

As shown in FIGS. 1B and 3B, each peripheral board 50 may be removably attached to the central platform 30 via one or more dowel pins or pegs 40. Specifically, each peripheral board 50 may comprise a front edge portion 52 that defines openings or bores 58 that are dimensioned and positioned to align with the bores 38 formed in a respective edge portion 32 of the central platform 30. In this manner, opposing ends of each peg 40 may be inserted into the respective bores 38 and 58 in a press-fit manner to removably secure each peripheral board 50 to the central platform 30. As described above, it is also contemplated that each peripheral board 50 may be removably secured to the central platform 30 using other suitable attachment means, such as, for example, hooks and eye hooks (see e.g., FIG. 6), hinges, resilient snaps/tabs, clasps, hooks, keys and slots, tongue and grooves, resilient clips, removable fasteners (screws, nuts, bolts), and the like. Additionally or alternatively, one or more of the peripheral boards 50 can be rotatably attached to the central platform 30, such as via removable or nonremovable hinges or the like.

In some embodiments, it is contemplated that the peripheral boards may be removably attached to adjacent peripheral boards using attachment means, for example, hinges, resilient snaps/tabs, clasps, hooks, keys and slots, tongue and grooves, resilient clips, removable fasteners (screws, nuts, bolts), and the like.

In other embodiments, it is contemplated that the central platform and the peripheral boards may comprise a monolithic structure, whereby the peripheral boards and the central platform are integrally formed during a plastic injection molding or wood working operation such that the peripheral boards and the central platform are permanently joined together, e.g., thereby obviating the need to removably attach the peripheral boards to the central platform via pegs or any other examples of attachment means described herein. In such embodiments, it is contemplated that the entire game board assembly may rest on a support surface (with no legs) or be elevated therefrom via legs attached to a lower surface thereof.

As shown in FIG. 3B, each edge portion 32 of the central platform 30 may be beveled at an angle α (for example 20°) relative to a vertical plane A such that no gap is formed between the central platform 30 and the peripheral board 50, respectively, when the peripheral board 50 is removably attached to the central platform 30. This feature is particularly beneficial for enabling game bags 70 tossed onto the modular game assembly 20 to slide between the upper surface 30*a* of the central platform and the upper surfaces 51 of the peripheral boards 50, respectively, without getting caught or entangled by a gap, that otherwise would exist therebetween. While the illustrated embodiment shows the edge portion 32 of the central platform 30 is beveled, it should be understood that the front edge portion 52 of each peripheral board 50 may alternatively be beveled in such embodiments wherein the edge portions 32 of the central platform 30 are aligned with the vertical plane A. In yet another embodiment (not shown), it is contemplated that each of the edge portions 32 and 52 may be beveled, for example, by 10° relative to a vertical plane.

Similarly, and as shown in FIG. 3C, it should be appreciated that abutting edge portions 53 of the peripheral boards 50 may be beveled at an angle α relative to a vertical plane A (for example 10° relative to a vertical plane) such that no gap is formed between the abutting edge portions 53 when the peripheral boards 50 are secured to the central platform 30. As noted above, this feature is particularly beneficial for enabling game bags 70 tossed on the modular game assembly 20 to slide between the upper surfaces 51 of adjacent peripheral boards 50, respectively, without getting caught or entangled by a gap, that otherwise would exist therebetween.

Referring to FIG. 1A, when the peripheral boards 50 are attached to the central platform 30 as described above, each of the peripheral boards 50 will be in abutting arrangement with the central platform 30 and with adjacent peripheral boards 50 giving the modular game assembly 20 a generally honeycomb like appearance. Moreover, and as shown in FIG. 3C, a front edge portion 52 of each peripheral board 50 will be raised relative to a rear edge portion 56 thereof such that each peripheral board 50 is downwardly inclined from the front edge portion 52 to the rear edge portion 56 thereof. In this manner, the front edge portion 52 of each peripheral board 50 is elevated and supported by the central platform 30 without the use of legs or other support members. In other embodiments, it is contemplated that the front edge portion 52 and the rear edge portion 56 of each peripheral board 50 may be elevated with respect to a support surface such that an upper surface 51 thereof is substantially flat, for example, in such embodiments wherein legs are attached (not shown) to a lower surface of each peripheral board 50, e.g., in the vicinity of the front and rear edge portions 52 and 56 of each peripheral board 50, respectively, or in the vicinity of the rear edge portion 56 in such embodiments wherein the front edge portion 52 is raised and supported by the central platform 30. In this manner, it should be understood that the upper surface 51 of each peripheral board 50 may be flat or substantially coplanar with the upper surface 31*a* of the central platform 30. As shown in FIG. 1A, when the peripheral boards 50 are attached to the central platform 30, as described above, exposed edge portions 55 of each peripheral board in the vicinity of the support surface define a plurality of openings 80 therebetween. In particular, these openings 80 define access openings that enable players to place their hands underneath the modular game assembly 20 to retrieve game bags 70 that may be lying beneath the modular game assembly 20.

Figure 5:
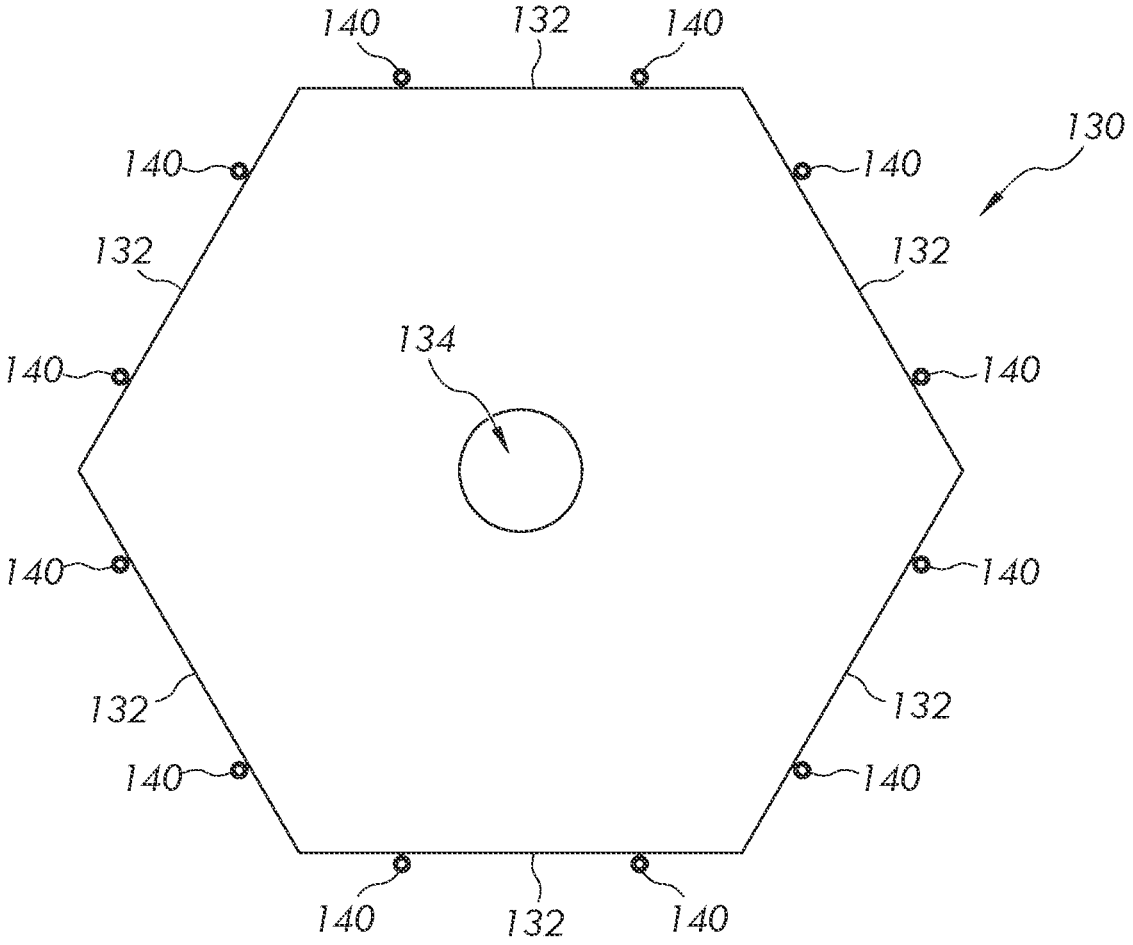
FIG. 5 illustrates a top view of an example central platform of the modular game assembly of FIG. 4.
Figure 6:
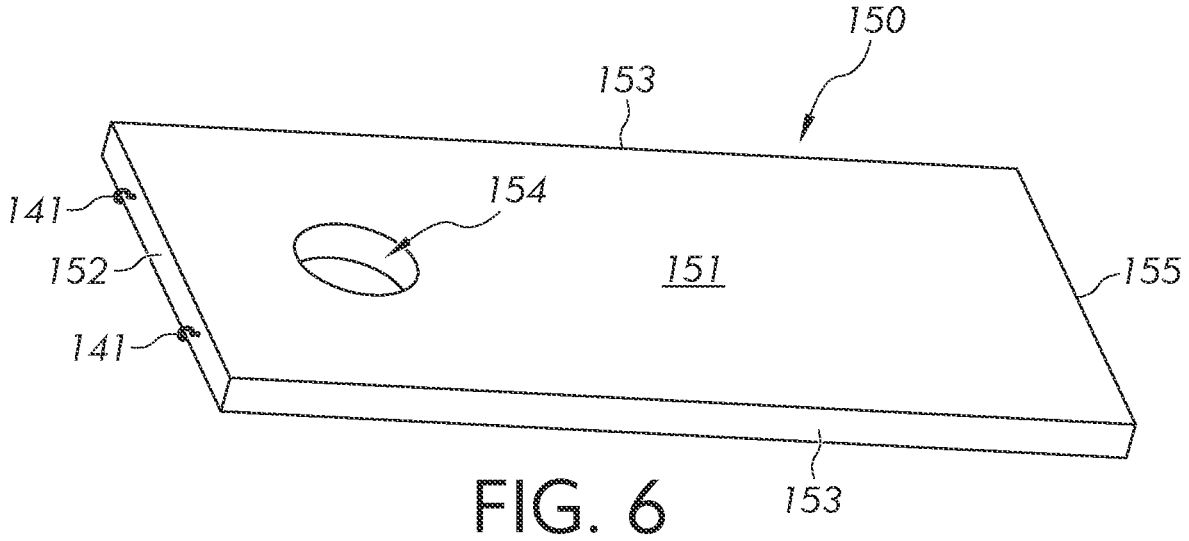
FIG. 6 illustrates a side perspective view of an example peripheral board of the modular game assembly of FIG. 4.

Turning now to FIGS. 5-6, a modular game assembly 120 according to a second embodiment is shown. The modular game assembly 120 includes a central platform 130 and a plurality of peripheral boards 150 removably attached to the central platform 130. The central platform 130 of the second embodiment is substantially similar to the central platform 30 of the first embodiment, except as noted below. In particular, and referring to FIG. 5, a plurality of eye hooks 140 may be secured to side edge portions 132 of the central platform 130 and extend outwards therefrom for securing the peripheral boards 150 thereto. Specifically, each eye hook 140 is configured to removably receive and engage a hook 141 (FIG. 6) disposed on an opposing front edge portion 152 of a respective peripheral board 150. However, it is also contemplated that the peripheral boards 150 of the second embodiment may be removably secured to the central platform 130 utilizing other suitable attachment means, such as, for example, hinges, resilient snaps or tabs, clasps, hooks, keys and slots, tongues and grooves, clips, or removable fasteners (screws, nuts, bolts and the like).

Referring to FIG. 6, the peripheral boards 150 of the second embodiment each embody a substantially rectangular-shaped body defined by a front edge portion 152, a rear edge portion 155, and a pair of longitudinally extending side edge portions 153. A central opening 154 extends between an upper surface 151 and a lower surface (not shown) of each peripheral board 150 and defines a scoring hole that is dimensioned to receive game bags 70 that are tossed therethrough. Preferably, the upper surface 151 of each peripheral board 150 is visually distinctive relative to the upper surfaces of the other peripheral boards 150 and can be coated or molded with distinct colors or include other surface indicia for achieving the same.

The upper surface 151 of each peripheral board 150 comprises a planar surface that is preferably a low friction surface. e.g., smooth plastic, sanded wood with a low friction coating. In particular, the upper surface 151 of each peripheral board 150 is designed with a suitable friction coefficient that enables game bags 70 landing on the upper surface 151 to slide thereon for facilitating a method of game play (discussed below), but without slipping to the support surface (e.g., a lawn, concrete surface, table) when the peripheral boards 150 are secured to the central platform 130 and inclined relative to the support surface. Yet, in other embodiments, it is contemplated that the upper surface 151 of each peripheral board 150 may include an impediment surface (e.g., rubber inlays, notched surfaces or grooves, and the like) for providing a frictional interface such that game bags 70 thrown on the upper surface 151 do not slide thereon, or slide to a lesser extent than without the impediment surface.

As shown in FIG. 6, one or more hooks 141 may be attached to the front edge portion 152 and positioned to align with the eye hooks 140 disposed on the respective side edge portion 132 of the central platform 130. Specifically, each peripheral board 150 may be secured to the central platform 130 by attaching the hook 141 disposed on the front edge portion 152 thereof to a corresponding eye hook 140 of the central platform 130.

Figure 4:
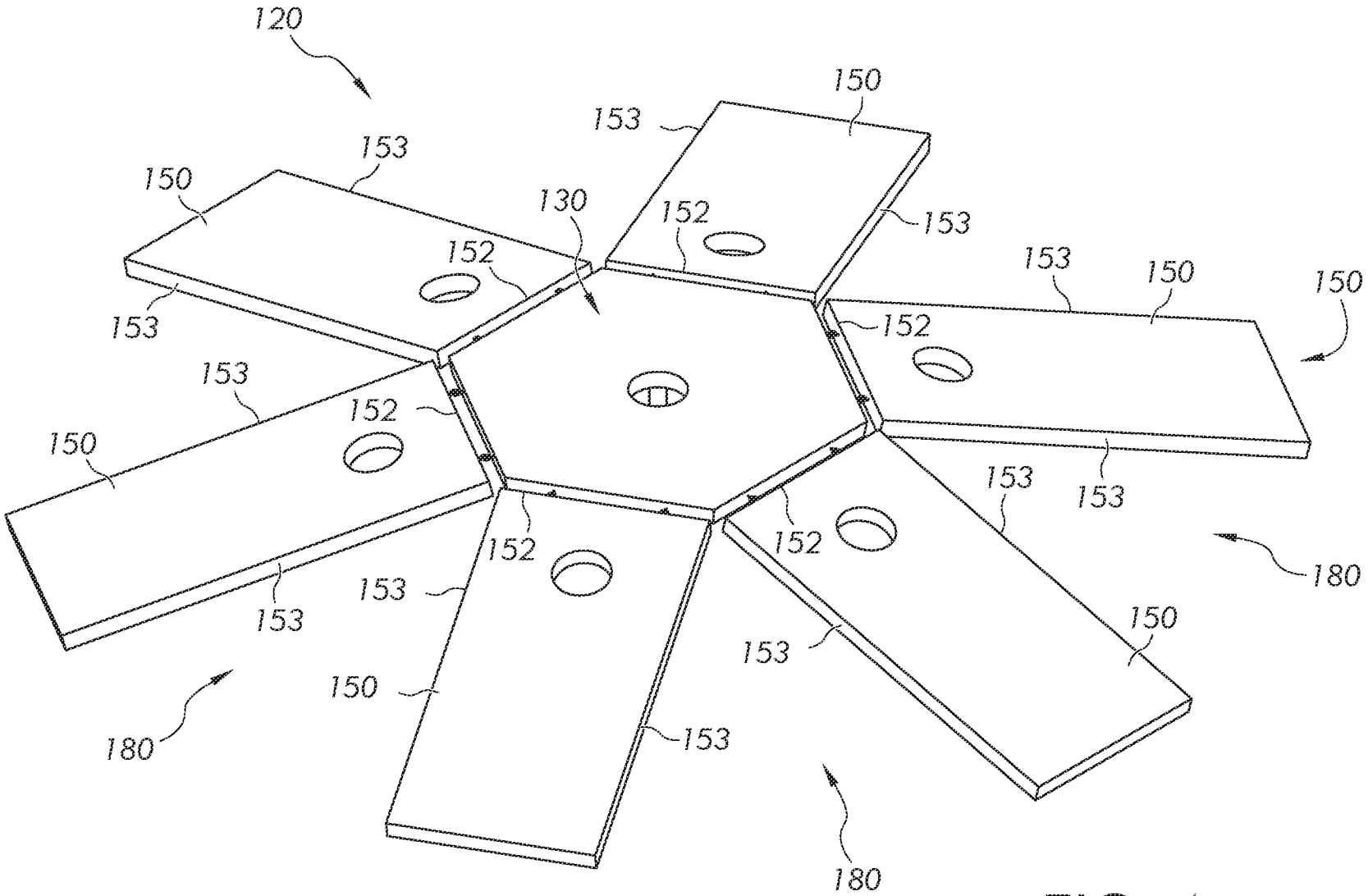
FIG. 4 illustrates a front perspective view of a modular game assembly according to a second embodiment.

Referring to FIG. 4, when the peripheral boards 50 are assembled to the central platform 130, the front edge portion 152 of each peripheral board 150 will be raised relative to the rear edge portion 155 thereof such that each peripheral board 150 is downwardly inclined from the front edge portion 152 to the rear edge portion 155. In this manner, the front edge portion 152 of each peripheral board 150 is elevated and supported by the central platform 130 without the use of legs or other support members. In the illustrated embodiment, the side edge portions 153 of the respective peripheral boards 150 define a plurality of openings 180 therebetween. These openings 180 define access openings that enable players to place their hands underneath the modular game assembly 120 to retrieve game bags 70 that may be lying beneath the modular game assembly 120.

Figure 8:
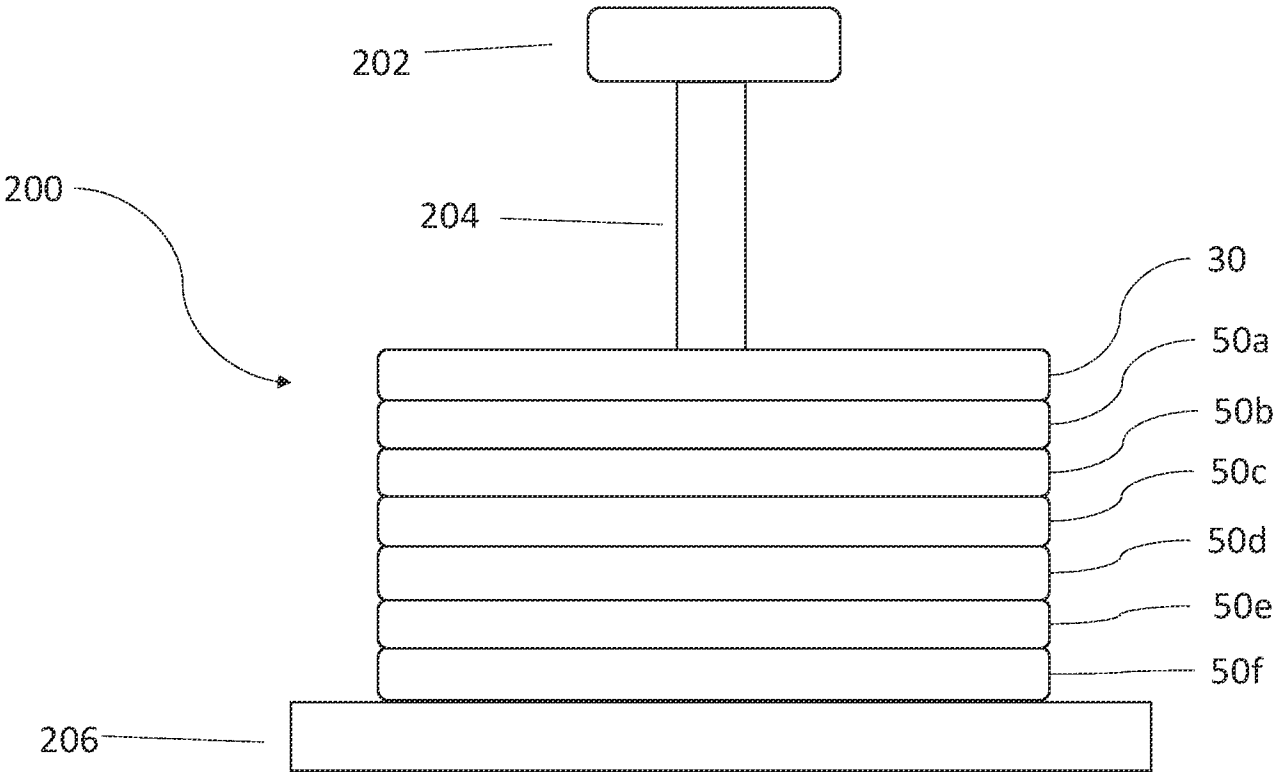
FIG. 8 is a schematic illustration of a carrier for a modular game assembly kit.

Referring to FIG. 8, an example of a carrier 200 for storing and transporting the peripheral boards 50 and the central platform 30 of the first embodiment is shown. The carrier 200 may include a central post 204 and a pedestal 206. A handle 202 may be attached to an upper, distal end of the central post 204 such that the carrier 200 may be lifted via the handle 202, for example, to conveniently transport the modular game assembly. In the illustrated embodiment, the central platform 30 and the peripheral boards 50 are stacked on the pedestal 206. In particular, the central post 204 is sized and dimensioned such that it may be received by the central openings 34 and 54 formed in the respective central board 30 and the peripheral boards 50. While the illustrated embodiment depicts peripheral boards 50 and the central platform 30 of the first embodiment, it should be understood that the stackable carrier 200 may also be sized and dimensioned to accommodate the central platform 130 and peripheral boards 150 of the second embodiment.

Figure 7A:
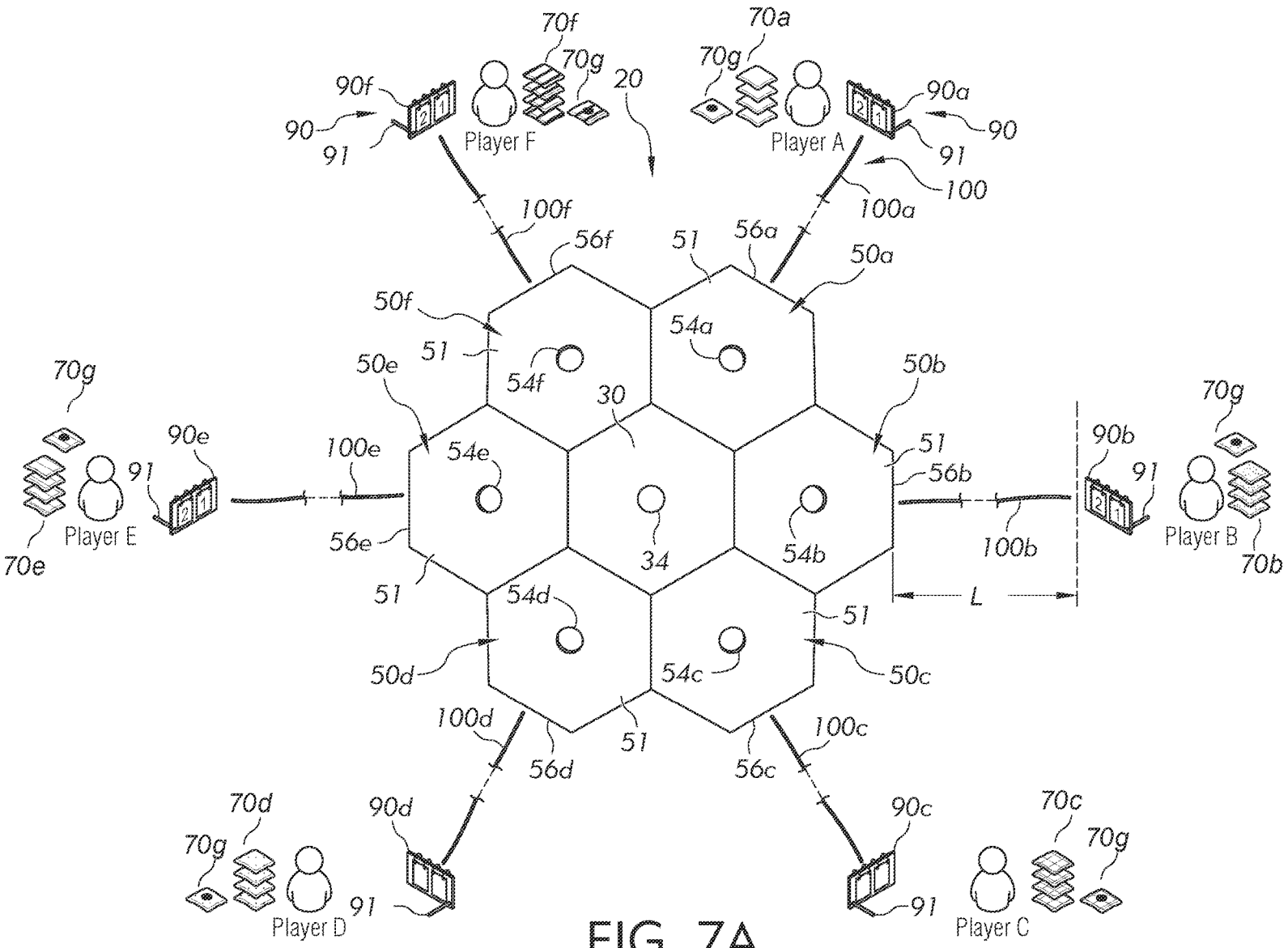
FIG. 7A illustrates a top view of the modular game assembly of FIG. 1, shown in relation with players, game pieces, and score counters to depict game setup as herein disclosed.

Turning to FIG. 7A, an example game setup corresponding to the modular game assemblies 20 and 120 described herein will now be described. The game setup will be described with reference to the modular game assembly 20 of the first embodiment. Because the game setup described herein equally applies to the modular game assembly 120 of the second embodiment, a corresponding description therefor has been omitted for brevity.

When the modular game assembly 20 is assembled as described above, it may facilitate game play between two to six players. For instance, six players may be associated or assigned to the peripheral boards 50*a*, 50*b*, 50*c*, 50*d*, 50*e*, 50*f*, respectively. Yet, the modular game assembly 20 may also accommodate a fewer number of players. For instance, in one embodiment, two players may be associated with opposing peripheral boards 50*a* and 50*d*. In another embodiment, three players may be associated with boards spaced apart relative to each other, for example, peripheral boards 50*a*, 50*c*, and 50*e*, respectively. In a further embodiment, four players may be associated with peripheral boards 50*b*, 50*c*, 50*e*, and 50*f*, respectively. In yet a further embodiment, five players may be associated with five peripheral boards 50*a*, 50*b*, 50*c*, 50*d*, 50*e*, respectively. Facilitating game play between two to six players in the manner described above is particularly beneficial for accommodating social gatherings wherein certain players may need to leave the social gathering, or wherein new players desire to participate in the game. This aspect of the modular game assembly 20 is especially advantageous for accommodating an even or odd number of players, in distinction to conventional lawn games that always require an even number of players. In some examples, it is contemplated that the modular game assembly 20 may be preassembled such that only certain peripheral boards 50 are attached to the central platform 30 as needed, for example, peripheral boards 50*a*, 50*c*, and 50*e* corresponding to players A, C, and E.

Preferably, and as described above, each peripheral board 50 comprises a distinct color or surface indicia (e.g., a pattern, surface marking, and the like) to distinguish a player's peripheral board relative to the other player's peripheral boards. Similarly, and referring to FIG. 1A, each player may be provided with a distinct set of game bags 70. For instance, for a six player game, six players may be provided with game bag sets 70*a*, 70*b*, 70*c*, 70*d*, 70*e*, and 70*f*, respectively, wherein each set comprises four game bags. Preferably, each game bag set comprises a distinct color or other surface indicia (e.g., a pattern, surface marking, and the like) to distinguish a player's game bag set relative to the other players' respective game bag sets. Ideally, a player's game bag set includes color or surface indicia corresponding to the color or surface indicia of the player's corresponding peripheral board 50.

Furthermore, each player may be provided with one additional bonus game bag 70*g* (FIG. 1A) corresponding to the player's respective game bag set. Preferably, each bonus game bag 70*g* comprises the same color or surface indicia of its corresponding game bag set, with an additional feature (e.g., a colored dot, diamond, hexagon) that distinguishes the bonus game bag 70*g* as a game bag that is intended for use during a special bonus round of play, as described in detail below. While the example description provided above is based on a six-player game, it should be appreciated that game setup may accommodate a fewer number of players, for example, three players with game bag sets 70*a*, 70*b*, 70*c* and their respective bonus game bags 70*g*.

During game setup, each player may also be provided a respective score counter 90 for keeping score, as described in detail below. For example, six players may be provided with score counters 90*a*, 90*b*, 90*c*, 90*d*, 90*e*, and 90*f*, respectively. As described above. it should be understood that game setup could alternatively accommodate a fewer number of players, e.g., three players with three score counters 90*a*, 90*b*, and 90*c*, respectively. In the illustrated embodiment, each score counter 90 embodies a score card board that is vertically supported by a rearwardly extending leg 91. Numerical score cards are pivotally attached to the score board via binder rings such that the score cards may be flipped to correspond to an appropriate score. Although it should be appreciated that other score counters are also contemplated, for example, digital score counters, dry-erase score boards provided with erasable markers, etc.

A line element 100 may be attached to each score counter 90. In some embodiments, the line element 100 may embody a piece of string. However, it is also contemplated that the line element 100 may embody a rope, twine, cable, cord, link chain, and the like. The line element 100 may be attached to the score counter 90 during game setup, or may be preassembled to the score counter 90 prior to the point of sale via any suitable attachment means, for example, by tying the line element 100 to the score counter 90 via a hole formed therethrough or via a hook, clip, or other suitable fastener. The line element 100 is formed such that it has a predetermined length L when fully extended, and preferably 10' in length.

In this manner, the line elements 100*a*, 100*b*, 100*c*, 100*d*, 100*e*, and 100*f*, may be radially extended such that the score counters 90*a*, 90*b*, 90*c*, 90*d*, 90*e*, and 90*f* are spaced relative to rear edge portions 56*a*, 56*b*, 56*c*, 56*d*, 56*e*, and 56*f* of the peripheral boards. In some embodiments, an end of each line element 100 proximate the rear edge portion 56 of a respective peripheral board 50 may be attached thereto via any suitable attachment means described herein, for example via a hook, a clip, or other suitable fastener. Yet, in other embodiments, it is contemplated that a single line element 100 may be provided for spacing the score counters 90*a*, 90*c*, 90*d*, 90*e*, and 90*f* relative to rear edge portions 56*a*, 56*b*, 56*c*, 56*d*, 56*e*, and 56*f* of the peripheral boards, for example, in such embodiments wherein the line element 100 is provided as a measuring device to facilitate game setup, e.g., measuring tape, line, etc.

When the score counters 90*a*, 90*b*, 90*c*, 90*d*, 90*e*, and 90*f* are positioned as described above, they will be spaced relative to the respective peripheral boards 50*a*, 50*b*, 50*c*, 50*e*, and 50*f* corresponding to the fully extended length of the respective line elements 100*a*, 100*b*, 100*c*, 100*d*, 100*e*, and 100*f*. In this manner, the positions of the score counters 90*a*, 90*b*, 90*d*, 90*e*, and 90*f* define player standing/sitting positions (and tossing distances) relative to the modular game assembly 20. This feature of the present disclosure is especially beneficial for alleviating the need to measure or estimate a standing position or tossing distance relative to the modular game assembly 20. Preferably, and as shown in FIG. 7, the score counters 90*a*, 90*b*, 90*c*, 90*e*, 90*f*, are positioned such that the numerical score cards are facing inwards toward the modular game assembly 20 such that the scores can be seen by opposing players during game play.

In some embodiments, the game setup includes determining a player tossing order. For instance, the tossing order may be determined by having participating players A, B, C, D, E, and F toss their respective game bags 70*a*, 70*b*, 70*c*, 70*d*, 70*e*, and 70*f* at their respective holes 54*a*, 54*b*, 54*c*, 54*d*, 54*e*, 54*f*, whereby the first player to successfully toss their game bag into their hole wins a decision process, and may elect to become the first player to toss their game bag during a first round of game play. In such embodiments, the remainder of the tossing order may be determined clockwise relative to the first player. For instance, if player B is the first player to toss their game bag 70*b* into their scoring hole 54*b*, player B may opt to become the first player to toss their game bag 70*b* during a first round of game play. Moving clockwise therefrom, player C becomes the second player, player D becomes the third player, and so on. In the event that multiple players simultaneously toss their game bags 70 into their respective scoring holes 54, the process may be repeated as between those players to determine the first player. Alternatively, the first player who successfully tosses their game bag 70 into their scoring hole 54 may also choose to start in a subsequent position, for example, third in the tossing order. In this example, the first player to begin a round may be determined counterclockwise therefrom. For instance, and assuming that player B is the first to successfully toss their game bag 70*b* into their respective scoring hole 54*b*, player B may opt to become the third player in the tossing order, whereby the first player in the tossing order is determined counterclockwise therefrom, e.g., player F, i.e., two spots preceding player B.

Figure 7B:
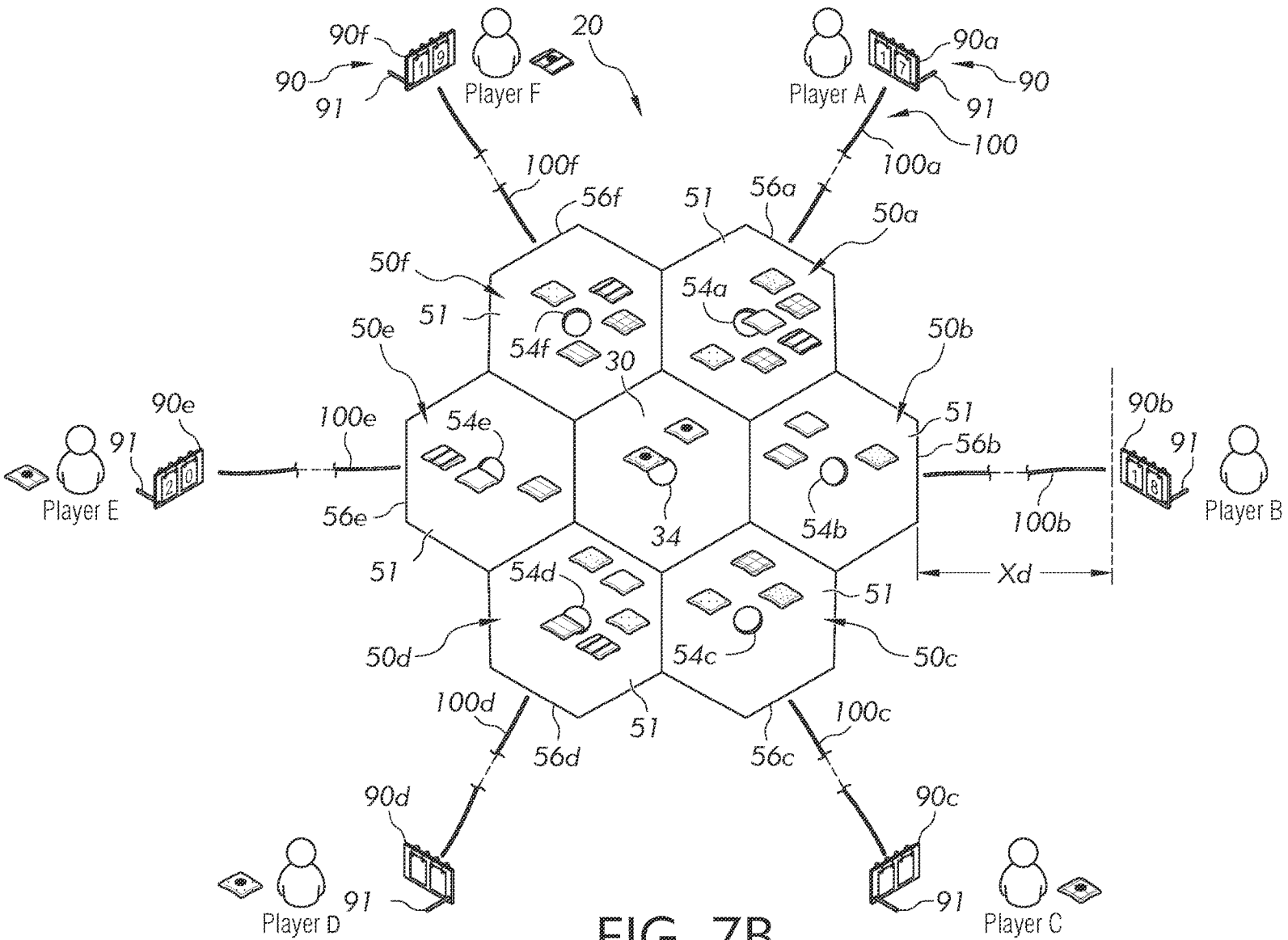
FIG. 7B illustrates a top view of the modular game assembly of FIG. 1, shown in relation with players, game pieces, and score counters to depict a method of game play as herein disclosed.

Referring to FIGS. 7A and 7B, an example method of game play corresponding to the modular game assemblies 20 and 120 described herein will now be described. The method of game play will be described with reference to the modular game assembly 20 of the first embodiment. Because the method of game play described herein equally applies to the modular game assembly 120 of the second embodiment, a corresponding description therefor has been omitted for brevity.

In general, the method of game play includes having players take turns tossing their respective game bags 70 at their respective peripheral boards 50 to accumulate points, or optionally at another player's peripheral board 50 to deduct points from that player.

The following description is based on a preferred example of game rules (Table 1) with six players A, B, C, D, E, and F participating in the game. Yet, it should be understood that the preferred example of game rules described herein may be modified without departing from the scope of the present disclosure. For example, initial point totals and scoring point values (e.g., points accumulated, deducted) may be different than the disclosed examples described herein.

TABLE 1

| Initial point total/cap | |
|---|---|
| 3-6 player game | 21 points |
| 2 player game | 15 points |
| **Scoring rules** | **Points Accumulated/Deducted** |
| Game bag landed on upper surface of player's own peripheral board | +1 |
| Game bag tossed through scoring hole of player's own peripheral board | +3 |

TABLE 1-continued

| Initial point total/cap | |
|---|---|
| Game bag landed on upper surface of opponent's peripheral board | −1 |
| Game bag tossed through scoring hole of opponent's peripheral board | −3 |
| Bonus game bag landed on upper surface of central platform during bonus toss | +1 |
| Bonus game bag tossed through scoring hole of central platform during bonus toss | +5 |

To begin, each player is accredited an initial point total that is uniformly set for all players. In the present example, each player is accredited 21 points corresponding to the rules for a three-six player game. Yet, it is contemplated that the rules may define a different initial point total. For instance, and according to the rules for a two-player game, each player is accredited 15 points.

Next, each player adjusts their respective score counter 90 (FIG. 7A) to depict the initial point total, for example, 21 points. According to the rules, each player cannot exceed their initial point total during game play. In this manner, the initial point total represents an upper limit or cap on the number of points a respective player can score. This aspect of the game rules induces a player with a score corresponding to their initial point total to move to another player's score counter 90 to attempt to deduct points from that player. Specifically, a player may deduct points from another player by either tossing their game bag 70 onto the upper surface 51 of that respective player's peripheral board 50, or through the hole 54 of that player's peripheral board 50.

To begin, each player is provided with a game bag set 70 corresponding to their respective peripheral board 50. In this example, players A, B, C, D, E, and F are provided game bag sets 70*a*, 70*b*, 70*c*, 70*d*, 70*e*, and 70*f* (FIG. 7A). Additionally, each player also receives their respective bonus game bag 70*g* which is designated for a special bonus toss at the end of a round of play, as described in detail below.

Then, a first round according to the example method of game play begins. For the purposes of this example, player A will be presumed to be the first player in the tossing order. Since player A cannot exceed their initial point total according to the game rules, player A will have to move to another player's score counter 90 to attempt to deduct points from that player by tossing their game bag 70*a* onto that player's peripheral board 50 or through the scoring hole 54 thereof. For example, player A may attempt to deduct points from any of players B-F. This aspect of the method of game play induces competitive tactics, based on a player's respective (or perceived) strengths and/or weaknesses. For example, player A may prefer to deduct points from player B, who player A perceives is an experienced player that is difficult to beat in subsequent rounds.

Accordingly, player A would have to move to player B's score counter 90*b* to attempt to toss their game bag 70*a* at player B's peripheral board 50*b*. According to the rules, if player A tosses their game bag 70*a* such that it lands on the upper surface 51 of player B's peripheral board 50*b*, one point will be deducted from player B's score. If player A tosses their game bag 70*a* into the scoring hole 54*b* of player B's peripheral board, three points will be deducted from player B's score.

Assuming that player A has successfully deducted points from player B's point total, player A or player B should update the score on player B's score counter 90*b* to reflect player B's score after the points deduction. Preferably, each player should adjust the score on their respective score counter 90 after each successful bag toss such that a player's current score is visually apparent to the other players throughout the game. This aspect of the method of game play helps players to contemplate strategies (for deducting, accumulating points, etc.), since each player's score will be visually apparent throughout the game.

Returning to the example, if player A deducted points from player B, for example, by tossing their game bag 70*a* through player B's scoring hole 54*b*, player B (the next player in the tossing order) may attempt to accumulate points since player B's score is now below their respective point total. In particular, player B may move to their score counter 90*b* and attempt to accumulate points by tossing their first game bag 70*b* at their peripheral board 50*b*. If player B lands their game bag 70*b* on the upper surface 51 of their peripheral board 50*b*, player B will accumulate one point. If player B tosses their game bag 70*b* through the hole 54*b* of their peripheral board 50*b*, player B will accumulate three points. Alternatively, and in distinction to conventional lawn games, player B may elect to move to another player's score counter 90 to attempt to deduct points from that player. For example, player B may move to player E's score counter and attempt to toss their game bag 70*b* at player E's peripheral board 50*e*.

After all of the players have tossed their first game bag moving clockwise from player A, player A may attempt to toss their second game bag 70*a*. In other words, the process repeats itself until all remaining players have taken turns tossing all four of their respective game bags 70.

When all of the players have taken turns tossing all of their game bags 70 (FIG. 7B), the method of game play requires the players to then take turns tossing their bonus game bags 70*g* at the central platform 30 during a bonus toss at the end of the first round. According to the game rules, if a player lands their bonus game bag 70*g* through the scoring hole 34 of the central platform 30, that player will accumulate five points. Alternatively, if a player lands their bonus game bag 70*g* on the upper surface 31*a* of the central platform 30, that player will accumulate one point. After each player has tossed their bonus game bag 70*g*, another round of game play according to the method described herein begins, whereby each player retrieves their respective game bags and bonus bag to begin the second round.

If a player's score reaches zero during the game (e.g., based on the point deductions described above), and if that player is unable to add points to their points total (for example, by tossing a game bag at their own peripheral board), that player will be eliminated such that the game will continue without that player. Moreover, a player's score cannot be negative throughout the game. In this manner, and when only two players remain, the game is over when one of the players' scores is zero, such that the player with points remaining is declared the winner. Alternatively, the first of the remaining two players to attain a score corresponding to the initial point total (e.g., 21 points) is declared the winner.

In some examples, the rules may limit a player from the number of times that player may attempt to deduct points from another player during a round. Similarly, the game rules may limit a player from the number of times that player may attempt to accumulate points during a round. For instance, and according to a preferred example for a three-six player game, each player may only toss two of their respective game bags 70 at another single player's peripheral board 50 during a round of game play to attempt to deduct points from that player. Conversely, each player may only toss one of their respective game bags 70 at their own peripheral board to attempt to accumulate points during a round of game play. According to some examples, and when only two players remain, each player may toss up to three bags at an opposing player's peripheral board, and only one at their own peripheral board.

In further examples, the rules may enable players to exceed the aforementioned limits by sliding their game bags onto another player's peripheral board. For example, if player A has already tossed two of their respective game bags 70*a* at player B's peripheral board 50*b*, then player A would be unable to toss a third game bag 70*a* at player B's board during that round. However, player A may attempt to toss their game bag such that it slides onto player B's peripheral board, for example, by tossing it at another player's peripheral board (or the central platform) and then sliding it onto player B's peripheral board. Sliding game bags can also be beneficial for attempting to dislodge another player's own game bags from that player's peripheral board to deduct points from that player. In addition, or alternatively, it is contemplated that a player may attempt to dislodge another player's game bags from their own peripheral board to add points to their point total, e.g., to regain points previously deducted by an opposing player's game bag thrown onto or resting on that player's own peripheral board.

In some examples, if a player facing elimination (with a score of zero) is unable to add points, for example, because they have tossed more than one game bag at their own peripheral board in a game with limits (discussed above), that player may toss their next game bag at another player's peripheral board to attempt to deduct points from that player, whereby all remaining game bags belonging to that player are forfeited, except for that player's bonus game bag. If the player facing elimination is unable to add points during the bonus toss with their bonus game bag, then that player will be eliminated.

It is contemplated that in some scenarios, a player's game bag may land on two peripheral boards. In such scenarios, points are accumulated or deducted based on the board that the respective game bag makes more contact with, e.g., more than 50% contact with. This determination may be made by unbiased players. In some examples, it is contemplated that a determination cannot be made as to which peripheral board a game bag makes more contact with, for example when unbiased players believe that a game bag is equally resting on adjacent peripheral boards. For instance, if a player's own game bag is partially resting on that player's own peripheral board and on an opposing player's peripheral board, it is contemplated that the rules may deduct points from each player. Similarly, if a player's own game bag is partially resting on two opposing player's peripheral boards, it is contemplated that the rules may deduct points from both players' respective scores. In some examples, it is contemplated that a player's game bag may partially contact an upper surface of the central platform and an upper surface of a peripheral board. In such instances, it is contemplated that the rules may award zero points if a regular game bag (i.e., not the bonus game bag) makes more contact with the central platform during a regular round of game play. Similarly, it is contemplated that a bonus game bag may partially contact a peripheral board and the central platform. In such instance, the rules may award zero points to a player if the bonus game bag makes more contact with a peripheral board. Conversely, it is contemplated that the rules may award points to that player if their bonus game bag makes more contact with the central platform. In a preferred example, the rules may stipulate that game bags thrown on the ground or support surface have no influence on a respective player's point total. Furthermore, the rules may stipulate that game bags making partial contact with the ground or support surface are immediately considered out of the field of play, and thus do not influence any player's respective score.

Illustrative embodiments have been described, hereinabove. It should be appreciated that features of the embodiments described herein may be combined. Therefore, this disclosure is not limited to the specific details and representations shown and described. For example, it should be appreciated that the modular game assemblies and methods described herein may be adapted. It will be apparent to those skilled in the art that the above game assemblies, methods, and rules may incorporate changes and modifications without departing from the scope of this disclosure. The invention is therefore not limited to particular details of the disclosed embodiments, but rather encompasses the spirit and the scope thereof as embodied in the appended claims.

What is claimed is:

1. A modular game assembly for a tossing game, the modular game assembly comprising:

a planar central platform that is elevated relative to a support surface supporting the central platform, said planar central platform defining a planar surface and having a plurality of edge portions; and a plurality of peripheral boards, wherein each peripheral board is coupled to one of the plurality of edge portions of the planar central platform and in an abutting arrangement therewith, wherein the planar central platform and the peripheral boards each comprise a hexagonal shaped body, and wherein said peripheral boards comprise six peripheral boards;

wherein each peripheral board is in an abutting arrangement with respect to an adjacent peripheral board, and wherein each peripheral board defines a planar surface inclined relative to the planar surface of the planar central platform, and wherein the planar central platform and at least one peripheral board includes an opening defining a scoring hole.

2. The modular game assembly according to claim 1, wherein the planar surface of each peripheral board is visually distinct with respect to the planar surfaces of other peripheral boards, respectively.

3. The modular game assembly according to claim 1, wherein each peripheral board includes a front edge supported by the planar central platform and a rear edge that is supported by the support surface such that each peripheral board is downwardly inclined from the front edge to the rear edge end thereof.

4. The modular game assembly according to claim 3, wherein each of the plurality of edge portions includes at least one first bore for receiving a first end of a peg, and wherein each peripheral board includes a mating edge, the mating edge having a second bore for receiving a second end of the peg to removably attach each peripheral board to the planar central platform.

5. The modular game assembly according to claim 1, wherein the peripheral boards each comprise a front edge that is shaped and dimensioned to mate with a respective edge of the planar central platform such that no gap is defined between the central platform and the front edge of each peripheral board when the peripheral boards are attached to the planar central platform.

6. The modular game assembly according to claim 1, wherein the peripheral boards each include abutting edges, wherein each abutting edge is shaped and dimensioned to mate with a respective abutting edge of an adjacent peripheral board such that no gap is defined between the abutting edges when the peripheral boards are attached to the planar central platform.

7. The modular game assembly according to claim 1, wherein each of the peripheral boards include an opening defining a scoring hole.

8. The modular game assembly according to claim 1, wherein the planar central platform includes a lower surface, and wherein a plurality of legs are secured to the lower surface to elevate and support the planar central platform upon the support surface.

9. The modular game assembly according to claim 8, wherein a plurality of bores are formed in the lower surface of the planar central platform, each bore being sized and dimensioned to removably receive an upper end of each leg.

10. The modular game assembly according to claim 1, further comprising:

a plurality of line elements each defining a predetermined length, wherein said plurality of line elements may be radially extended from rear edges of the respective peripheral boards to define player standing or sitting positions relative to the modular game assembly.

11. The modular game assembly according to claim 10, further comprising:

plurality of score counters, wherein each score counter is spaced relative to a respective peripheral board via the predetermined length of said line elements.

12. The modular game assembly according to claim 1, wherein each of the plurality of peripheral boards is at least one of rotatably or removably attached to the planar central platform.

13. A kit for a tossing game, the kit comprising:

a carrier;

a modular game assembly according to claim 1;

a plurality of score counters;

at least one line element; and a plurality of game bag sets corresponding to each of said plurality of peripheral boards.

14. The kit according to claim 13, wherein the carrier further comprises:

a pedestal and a central post attached thereto, wherein the peripheral boards and the planar central platform of the modular game assembly each define an opening that is dimensioned to receive the central post therethrough such that the peripheral boards and the planar central platform may be stacked on the pedestal and secured thereto by inserting the central post through the respective openings.

15. A method of game play for a tossing game, the method comprising:

providing a modular game assembly according to claim 1 and a plurality of game bag sets corresponding to the respective peripheral boards;

assigning an initial point value;

selecting a plurality of players and assigning each of said plurality of players to a respective peripheral board;

distributing said game bag sets to said respective players;

commencing a tossing game whereby each player, in order, tosses a game bag from their respective game bag set at the modular game assembly according to rules, comprising:

deducting points from a player's score when an opposing player tosses a game bag from their respective game bag set on said player's assigned peripheral board or through a scoring hole formed in said player's assigned peripheral board;

adding points to said player's score when said player tosses a game bag from their respective game bag set on said player's assigned peripheral board or through a scoring hole formed in said player's assigned peripheral board; and determining a score after each toss, eliminating players from the game when their respective score is zero, and determining a winner when two of said players remain and, and wherein the winner is one of said two players with a score equal to said initial point value or with points greater than zero.

16. The method of game play according to claim 15, wherein each of said game bag sets include a bonus game bag, and whereby each player takes turns, in order, tossing their respective bonus game bag at the central platform to attempt to accumulate points.

17. A modular game assembly for a tossing game, the modular game assembly comprising:

a central platform including:

an upper surface and a lower surface, and wherein a central opening extends between the upper surface and the lower surface, wherein the lower surface is elevated relative to a support surface supporting the central platform via a plurality of legs removably attached thereto, and wherein the upper surface is substantially horizontal when supported upon the support surface; and six edges; and a plurality of peripheral boards, wherein each peripheral board includes:

an upper surface, a lower surface, and a central opening extending between the upper surface and the lower surface, wherein each peripheral board includes six edges, said six edges comprising a front edge, a pair of abutting edges, a pair of exposed edges, and a rear edge, wherein each front edge is removably or rotatably attached to a corresponding one of said six edges of said central platform, and wherein said abutting edges of each peripheral board are shaped and dimensioned such that said peripheral boards are in abutting arrangement with respect to one another along a longitudinal length thereof.

* * * * *